US008595874B1

(12) United States Patent
Knapp

(10) Patent No.: US 8,595,874 B1
(45) Date of Patent: Dec. 3, 2013

(54) COMBINED OXYGEN TANK KEY, GLASS BREAKER AND BOTTLE OPENER

(76) Inventor: Joshua Knapp, New York, NY (US)

( * ) Notice: Subject to any disclaimer, the term of this patent is extended or adjusted under 35 U.S.C. 154(b) by 247 days.

(21) Appl. No.: 13/200,624

(22) Filed: Sep. 27, 2011

Related U.S. Application Data

(60) Provisional application No. 61/404,294, filed on Sep. 30, 2010.

(51) Int. Cl.
*B25F 1/00* (2006.01)

(52) U.S. Cl.
USPC ..... 7/151; 7/138

(58) Field of Classification Search
USPC ..... 7/151, 138; D8/27, 28, 33, 34, 105; 251/291; 285/39
See application file for complete search history.

(56) References Cited

U.S. PATENT DOCUMENTS

| | | | | |
|---|---|---|---|---|
| 4,871,144 | A | 10/1989 | Kaniaris | |
| 5,491,898 | A | 2/1996 | Riley | |
| 6,199,997 | B1 | 3/2001 | Outsen et al. | |
| 6,816,064 | B1 | 11/2004 | Ruiz | |
| D579,301 | S * | 10/2008 | Jones | D8/105 |
| D611,786 | S | 3/2010 | Knapp | |
| D611,787 | S | 3/2010 | Knapp | |
| D621,674 | S | 8/2010 | Knapp | |
| 2008/0307584 | A1 * | 12/2008 | Jones | 7/151 |

* cited by examiner

*Primary Examiner* — David B Thomas
(74) *Attorney, Agent, or Firm* — Norman E. Lehrer

(57) ABSTRACT

A combined oxygen tank key, glass breaker and bottle opener includes an elongated handle portion defining a first plane and having first and second ends that define the length thereof and first and second side edges that define the width thereof. A socket is integrally formed within the handle portion and is adapted to fit onto the rectangularly shaped end of an oxygen tank valve control stem. A hardened point is formed at the first end of the handle portion and is capable of breaking vehicle glass. A bottle opener is carried by the first side edge of the handle portion.

5 Claims, 3 Drawing Sheets

COMBINED OXYGEN TANK KEY, GLASS BREAKER AND BOTTLE OPENER

CROSS REFERENCE TO RELATED APPLICATION

This application claims the benefit of Provisional Patent Application No. 61/404,294, filed Sep. 30, 2010.

BACKGROUND OF THE INVENTION

The present invention is directed toward a combined oxygen tank key, glass breaker and bottle opener and more particularly toward an oxygen tank key that makes it easier for an operator to turn a tank on and off and to disconnect the regulator from the tank when desired and which can also function to break glass windows in an emergency. The tool also includes a bottle opener.

Portable oxygen tanks are frequently used by numerous patients having a variety of medical conditions that require them to supplement their oxygen intake. Under some situations, the tanks are left on for long periods of time. In other situations, the tanks must be turned on and off with considerable frequency. It is also common for emergency medical technicians and other first responders to administer oxygen to patients through the use of portable oxygen tanks.

Oxygen tanks must, of course, be turned on when needed and off when not. For this purpose, they are provided with a conventional valve which is opened by rotating the same counterclockwise and is closed by rotating the valve clockwise. In some cases, the valve stem of an oxygen tank is provided with an attached handle or the like to aid in rotating the valve into its open or closed position. Most tanks, however, do not include a handle. This is done to prevent someone from inadvertently turning the tank on when not needed and exhausting the oxygen or inadvertently turning the tank off when it is needed.

In lieu of an attached handle, most oxygen tanks are opened and closed through the use of a wrench or key that can be temporarily applied to the rectangularly shaped top of the valve stem. Conventional keys currently available are made from thin cast or sheet metal or the like that include a rectangularly shaped opening therein that is adapted to cooperate with the top of the valve stem. Such keys are useful for closing a valve but are frequently difficult to use when trying to open the same particularly if the valve had been closed too tightly. When using a conventional key, the operator's hand must engage the narrow side edge of the key. This can be uncomfortable and frequently can become painful, particularly after numerous operations. One form of a prior art conventional key is shown, for example, in U.S. Pat. No. 4,871,144 that issued in 1989 to Kaniaris.

As is also well known, oxygen from a tank must first pass through a regulator before being used by a patient. Such regulators are attached to the tank by clockwise rotating a thumb screw or lever connected to a screw thread that clamps the regulator into place. The regulator is removed by rotating the lever in the counterclockwise direction. Sometimes the clamp is so tight that it is difficult to rotate the same. When this occurs, a wrench or other tool must be used. Conventional oxygen keys are of little use for this purpose as they are designed solely to aid in turning the valve stem of an oxygen tank on and off. They cannot engage or turn a regulator lever. While the Kaniaris patented device referred to above suggests that it can be used for this purpose, it does not appear to provide the mechanical advantage that may be needed to loosen a regulator clamp that has been over tightened. Furthermore, the Kaniaris device can damage the thumb screw, making the unit inoperable, because pressure is applied to the thumb screw at an acute point of the tool, instead of at a mated surface.

The oxygen tank keys disclosed in Applicant's pending application Ser. No. 12/006,174, filed Dec. 31, 2007, and in Applicant's Design Patent Nos. D611,786; D611,787 and D621,674 help substantially to solve the foregoing problems. (The entire disclosures of the prior application and of each of the design patents are incorporated herein by reference.) The prior application and patents do not, however, address other problems faced by emergency personnel arriving at car crashes or house fires or the like. More particularly, it often becomes necessary to break the window glass of a car or house in order to gain access to the interior thereof. Tools such as shown in U.S. Pat. Nos. 5,491,898; 6,199,997 and 6,816,064 have been developed to break glass. However, the use of such tools would require the emergency personnel to carry an additional tool.

A need, therefore, exists for a tool that is easy and comfortable to use for turning an oxygen tank on and off, which can be used to help attach or detach a regulator to or from a tank and which can be used to break window glass.

SUMMARY OF THE INVENTION

The present invention is intended to overcome the deficiencies of the prior art discussed above. It is an object of the present invention to provide an oxygen tank key that is easy and comfortable to operate.

It is another object of the present invention to provide an oxygen tank key that can also be utilized to aid in the detachment of a regulator from an oxygen tank.

It is a further object of the present invention to provide an oxygen tank key that can be utilized in an emergency to break vehicle glass.

It is an even further object of the present invention to provide an oxygen tank key that can be utilized as a bottle opener.

In accordance with the illustrative embodiments demonstrating features and advantages of the present invention, there is provided a combined oxygen tank key, glass breaker and bottle opener that includes an elongated handle portion defining a first plane and having first and second ends that define the length thereof and first and second side edges that define the width thereof. A socket is integrally formed within the handle portion and is adapted to fit onto the rectangularly shaped end of an oxygen tank valve control stem. A hardened point is formed at the first end of the handle portion and is capable of breaking vehicle glass. A bottle opener is carried by the first side edge of the handle portion.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
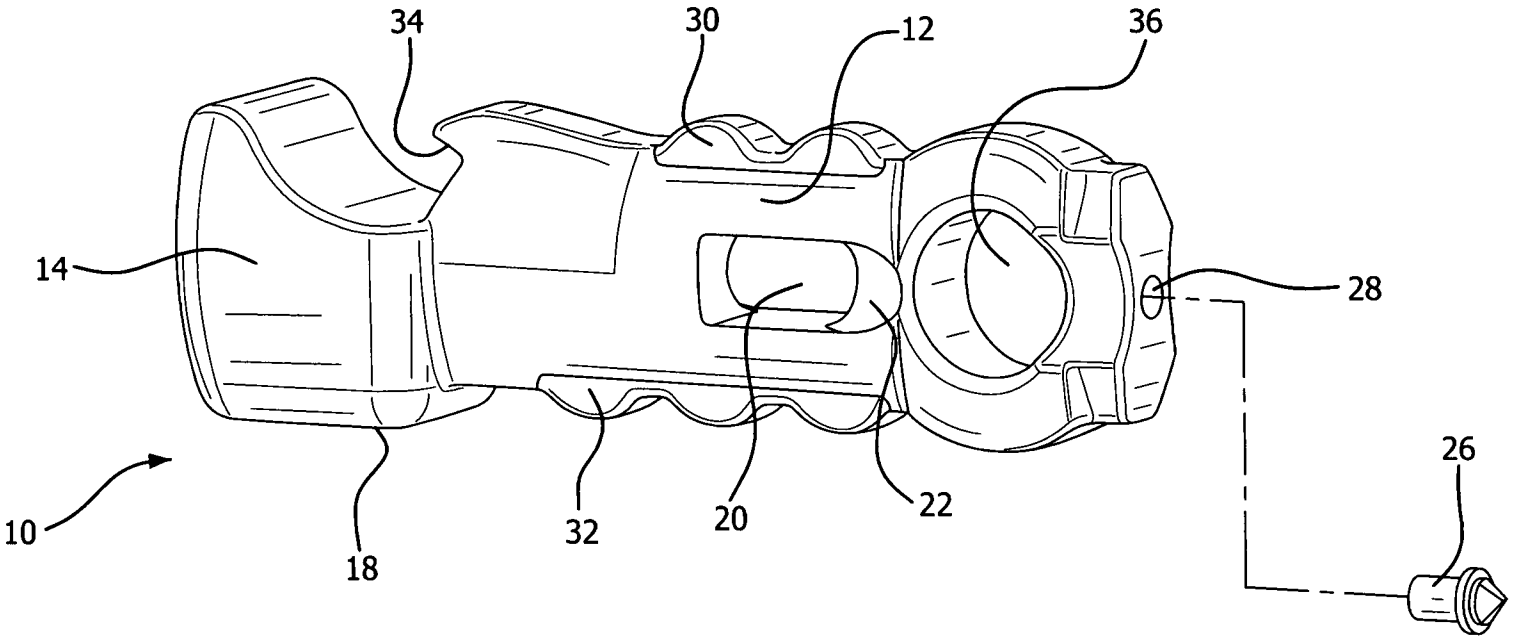
FIG. 1 is a top front perspective view of a combined oxygen tank key, glass breaker and bottle opener in accordance with the invention.
Figure 2:
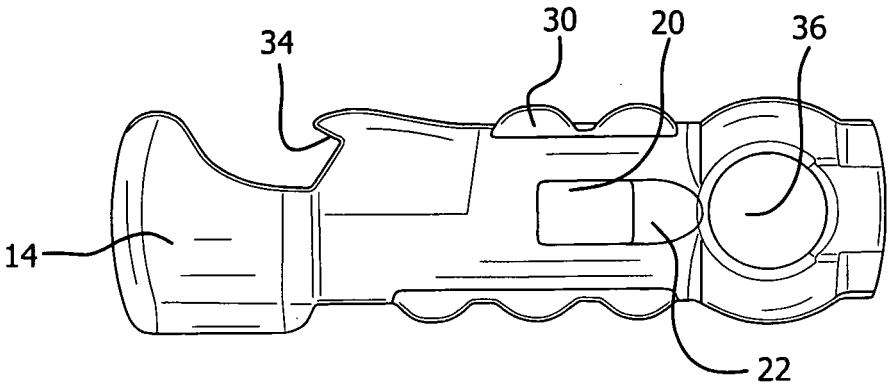
FIG. 2 is a front elevational view thereof.
Figure 3:
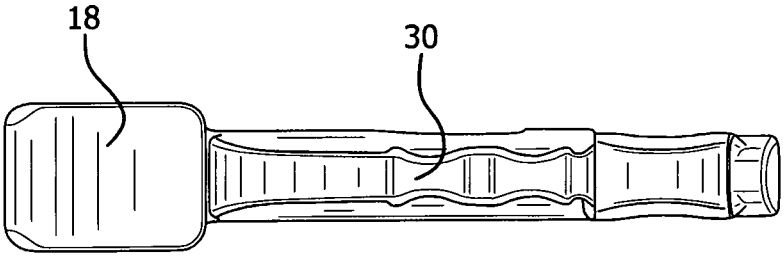
FIG. 3 is a top plan view thereof.
Figure 4:
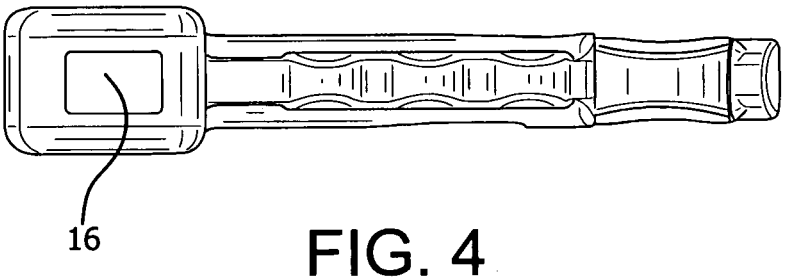
FIG. 4 is a bottom plan view thereof.
Figure 5:
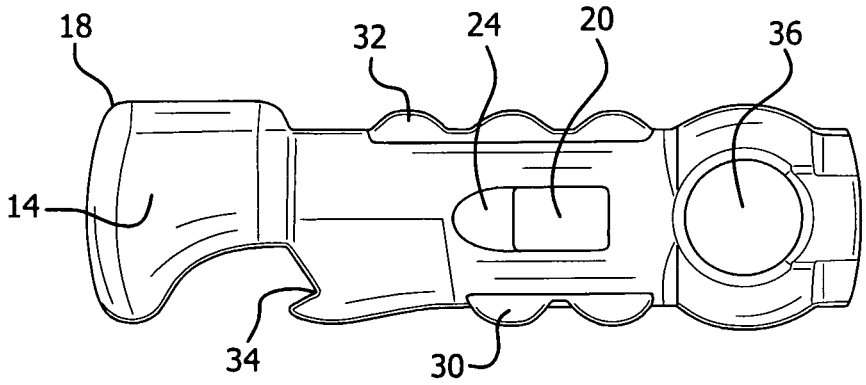
FIG. 5 is a rear inverted elevational view thereof.
Figure 6:
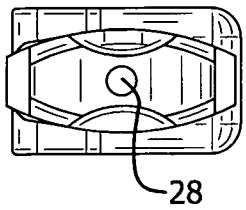
FIG. 6 is a right end elevational view thereof.

Referring now to the several drawings in detail wherein like reference numerals have been used throughout the various figures to designate like elements, there is shown in the figures the details of a combined oxygen tank key, glass breaker and bottle opener constructed in accordance with the principles of the present invention and designated generally as 10.

The oxygen tank key 10 is comprised essentially of an elongated block 12 of preferably cast aluminum or plastic or other similar material having a socket 14 integrally formed at one end thereof. An aperture or slot 16 is formed in and opens adjacent one side edge 18 of the key. The aperture 16 extends upwardly into the width of the key 10 but is preferably closed at the top. The aperture 16 has a substantially rectangular cross section and is adapted to fit onto the rectangularly shaped end of an oxygen tank valve control stem.

Another substantially rectangularly shaped slot or aperture 20 passes through the block 12 and may also be of proper dimension to fit the stem of an oxygen tank in order to turn the same on and off.

The key 10 of the present invention is also useful for loosening the yoke or clamp that attaches the regulator to the tank. This is accomplished by passing the lever of the clamp through the slot 20 and orienting the key 10 so that it is in line with the lever. To increase the leverage or mechanical advantage, the slot 20 has champhered edges 22 and 24 at the forward and rear thereof. The manner in which the mechanical advantage is accomplished and the interaction between the slot 20 and the clamp lever are explained in more detail in Applicant's prior application referred to above.

In order to easily break auto or vehicle glass or home window glass, the key 10 includes a hardened pointed tip 26 at one end thereof. The tip 26 may be made of various hardened materials as explained in the above prior art patents and is firmly held in the recess 28 formed in the end of the key body 12. Glass is broken by gripping the key 10 with a person's hand and striking the glass with the tip 26. The key 10 is preferably provided with a series of finger grips such as shown at 30 and 32 to make it easier to hold the key when striking the glass.

The key 10 of the present invention also includes a bottle opener 34 at one end thereof. The bottle opener 34 is used in the normal manner when it is desired to open a capped bottle that does not have a screw top.

The key 10 of the present invention may include an additional aperture 36 formed therein which may include a different shape for other types of oxygen or other air tanks. Alternatively, the aperture 36 may be used to allow the key 10 to be carried on a key chain or the like.

The present invention may be embodied in other specific forms without departing from the spirit or essential attributes thereof and accordingly, reference should be made to the claims rather than to the foregoing description as indicating the scope of the invention.

I claim:

1. A combined oxygen tank key, glass breaker and bottle opener comprising:

an elongated handle portion defining a first plane and having first and second ends that define the length thereof and first and second side edges that define the width thereof;

a socket integrally formed within said handle portion and being adapted to fit onto the rectangularly shaped end of an oxygen tank valve control stem;

a hardened point at said first end, said hardened point being capable of breaking vehicle glass, and a bottle opener carried by said first side edge of said handle.

2. The oxygen tank key as claimed in claim 1 wherein said socket is located intermediate said ends of said handle portion.

3. The oxygen tank key as claimed in claim 1 further including an elongated slot passing through said handle portion, said slot extending in the direction of the length of said handle portion.

4. The oxygen tank key as claimed in claim 3 wherein said slot is adapted to fit over the lever of a regulator for said oxygen tank to help release the regulator from said tank.

5. The oxygen tank key as claimed in claim 4 wherein said slot includes champhered ends.

* * * * *